US007181892B1

(12) United States Patent
Scott et al.

(10) Patent No.: US 7,181,892 B1
(45) Date of Patent: Feb. 27, 2007

(54) CAPPING HEAD WITH A MAGNETIC CLUTCH

(75) Inventors: Michael Patrick Scott, Midland, MI (US); Larry Dale Dotson, Midland, MI (US)

(73) Assignee: Precision Torque Control, Inc., Midland, MI (US)

( * ) Notice: Subject to any disclaimer, the term of this patent is extended or adjusted under 35 U.S.C. 154(b) by 0 days.

(21) Appl. No.: 11/295,819

(22) Filed: Dec. 7, 2005

(51) Int. Cl.
*B65B 3/20* (2006.01)

(52) U.S. Cl. ..... 53/331.5; 53/317

(58) Field of Classification Search ..... 53/331.5, 53/343

See application file for complete search history.

(56) References Cited

U.S. PATENT DOCUMENTS 4,364,218 A * 12/1982 Obrist ..... 53/331.5
4,599,846 A * 7/1986 Ellis et al. ..... 53/331.5
4,674,264 A * 6/1987 Ellis et al. ..... 53/331.5
5,197,258 A 3/1993 Johanek
5,313,765 A * 5/1994 Martin ..... 53/317
5,437,139 A 8/1995 Martin
5,490,369 A 2/1996 Ellis
5,714,820 A 2/1998 Mitsuhashi
5,809,742 A 9/1998 Takakusaki
6,240,678 B1 6/2001 Spether

* cited by examiner

*Primary Examiner*—John Sipos
(74) *Attorney, Agent, or Firm*—Robert L. McKellar; McKellar IP Law, PLLC

(57) ABSTRACT

A device that is useful for applying pre-threaded closures onto threaded containers with improved sensitivity. The device allows for the adjustment of the torque that is required for capping containers such that variable sizes and variable types of containers can be capped.

7 Claims, 4 Drawing Sheets

CAPPING HEAD WITH A MAGNETIC CLUTCH

The invention claimed and disclosed herein deals with a device that is useful for applying pre-threaded closures onto threaded containers with improved sensitivity.

BACKGROUND OF THE INVENTION

It is known in the art to use capping devices for applying threaded caps to pre-threaded containers. Such devices utilize a clutch to control the amount of torque applied to the cap so that the container is properly closed but prevents too much torque from being applied that could strip the threads of the container and the cap. Also, it is desired to prevent the over tightening of the cap.

This has been accomplished by using rings of concentric magnets with some form of control to control the axial position of the magnets. Various devices have also incorporated rings of magnets of alternating polarity. Even though such devices have been available, they have tended to be complex and costly, and not very reliable with regard to retaining the pre set torque, and thus many capping devices utilizing spring loaded mechanical and friction clutches are still in use but a need exists for a device incorporating a reliable and simplified but effective clutch mechanism.

One such device can be found in U.S. Pat. No. 5,197,258, issued Mar. 30, 1993 to Johanek in which a clutch is adapted for use in a capping device to apply a pre-selected amount of torque to the driven component having a pair of axially aligned circular cylinders of equal diameter each having a generally smooth engaging surface facing the other clutch cylinder. Each of the cylinders has cavities in the rear side for containing magnets. The magnets are secured in the cavities by means of a cured polymeric resin. The maximum torque provided by the clutch is controlled by using removable spacer disks of varying thicknesses and having a diameter equal to that of the cylinder positioned between the engaging surfaces.

The device disclosed in U.S. Pat. No. 5,437,139, issued on Aug. 1, 1995 to Martin deals with a cylindrical magnet ring in the body of the head surrounding a cap chuck driving element in a low friction bearing in the head, each having an array of permanent magnets, distributed around the periphery. The chuck driving element rotates with the magnet ring until the resistance of a cap being threaded on the container exceeds a predetermined torque limit, after which the magnet ring rotates relative to the stationary chuck driving element. The spring for urging the chuck downward is fully contained within the head.

Yet another device is that found in U.S. Pat. No. 5,809,742, that issued on Sep. 22, 1998 to Takakusaki, et al in which a plurality of permanent magnets are embedded around the entire outer periphery at the upper end of a spindle with adjacent permanent magnets presenting magnetic poles of different polarities. As the capping head moves through a threadable engaging zone, co action between the permanent magnets causes the capping head to rotate clockwise causing a cap to be threadably engaged with a container.

U.S. Pat. No. 5,714,820, that issued on Feb. 3, 1998 to Mitsuhashi, et al deals with magnetic coupling that includes a cylindrical housing, a spindle, an adjusting plate, two pairs of permanent magnet discs, two hysteresis material discs, and a screw member.

The spindle is rotatably supported at its axial position by the housing. The adjusting plate is rotatably supported by the spindle to partition as interior of the housing into two sections in a direction of the spindle. The two pairs of permanent magnets are provided in the two corresponding section to respectively oppose each other. One of each pair of permanent magnet discs is fixed in the housing and the other thereof is fixed to the adjusting plate. Each permanent magnet disc has magnetic poles with polarities that alternate in a circumferential direction. The hysteresis material discs are fixed to the spindle and arranged between the corresponding pairs of permanent magnet discs at a predetermined gap. The screw member fixes the adjusting plate to the housing. When the adjusting plate is released and pivoted, the mutual positional relationships between the respective opposing magnetic poles of the two pairs of permanent magnet discs are adjusted simultaneously.

U.S. Pat. No. 6,240,678 that issued Jun. 5, 2001 to Spether, deals with a capping head assembly that has a first housing with a spindle mounting collar and supports a clutch housing. The clutch housing has an upper portion with a first magnetic ring and a lower portion with a second magnetic ring. The lower portion is freely rotatable relative to the upper portion and permits the adjustment of the air gap between the first and second magnetic rings. A locking mechanism maintains the adjusted air gap at a selected value that represents a definable torque level in the magnetic clutch. The capping head also includes a post assembly calibration system that establishes a known reference point. that compensates for manufacturing tolerances between individual capping heads.

There is disclosed in U.S. Pat. No. 5,490,369, that issued Feb. 13, 1996, to Ellis, a capping head with magnetic clutch that includes a housing assembly including a magnetic clutch interconnecting a drive spindle and a quill for applying a closure to a container. The magnetic clutch consists of opposed rings of magnets and one of the rings is disposed in a piston ring assembly that is quick and easily adjustable relative to the other to vary the torque limit of the clutch. A simple yet efficient clamping assembly is employed to facilitate ready adjustment and retention of the movable piston ring.

There is shown in an Arol Company brochure, not dated, a synchronous magnetic type of head. This device differs from the device herein by the use of straight sided ball bearings as the contact thrust bearing, but more importantly, it uses a synchronous magnetic type of head as opposed to the hysteresis type of head as used in the inventive device herein.

Basically, the synchronous clutch utilizes two discs with multiple magnets that are set up to oppose each other. To rotate one of the discs relative to the other disc you must overcome the magnetic attraction from the north pole to the south pole. The torque is a pulsating torque from zero to maximum. The number of magnets located around the disc will determine how many pulsations there will be in one revolution. To change peak torque levels in this type of design you need to adjust the air gap between the magnets. Larger air gaps provide for smaller peak torques.

In the hysteresis clutch of the instant invention, the action is smooth. That is the primary benefit that the inventive device incorporates. The device has three magnet plates, not two. The hysteresis magnet is sandwiched between two multiple pole driver magnets. By varying the polar orientation of the driver magnets the magnetic saturation of the hysteresis magnet can be changed. A fully saturated magnet makes full torque and it is a smooth constant torque, not a pulsating torque. One need not deal with the air gap between the magnets in this type of device.

None of the devices disclosed in the prior art have the advantages of the device of the instant invention. None of the devices disclosed in the prior art have the simplicity and novel means of adjusting the torque in the magnetic clutch assembly as does the device of the instant invention. In addition, none of the devices of the prior art have the capability of being able to read the adjustments scale on the outside surface of the magnetic clutch assembly, nor the adjustments scale on the outside surface of the upper spring assembly for adjusting the tension in the spring.

The device of the instant invention does not rely on the gap between magnets for adjusting the torque therein.

THE INVENTION

The invention disclosed and claimed herein deals with a capping head assembly comprising a first housing assembly securable to a spindle drive, wherein the first housing assembly has an outside surface, a top portion, a middle portion, and a lower portion.

There is a spring retention plate surmounting the first housing assembly and there is a compression spring mounted beneath the spring retention plate and surrounding the first housing assembly. The spring slidably rests on a movable adjustment ring that is threadedly mounted around the middle portion of the first housing assembly.

There is a magnetic clutch assembly having an upper portion and a bottom edge and which comprises a first annular drive magnet in a torque ring that is not movable relative to the magnetic clutch assembly. The drive magnet has a multiple pole configuration and there is a second annular drive magnet in the magnetic clutch assembly and it has a multiple pole configuration. There is a moveable hysteresis annular magnet interposed between the drive magnets, said magnets being axially spaced from each other.

There is a means for adjusting the position of the torque ring relative to the magnetic clutch assembly, the means comprising a torque adjustment rotating end cap that changes the polarity of the second annular magnet in the magnetic clutch assembly relative to the first annular drive magnet in a predetermined position whereby the flux of the magnets can be changed to vary the torque limit of the magnetic clutch assembly. The torque adjustment rotating end cap is rotatably mounted in the bottom end of the magnetic clutch assembly.

There is a means for securing the torque ring relative to the magnetic clutch assembly to retain the torque ring in a fixed position.

There is a double row angular contact thrust bearing located in the upper portion of the magnetic clutch assembly and encircling the rotatable drive member, the double row angular contact thrust bearing surmounting the first annular series of magnets.

Optionally, there is a top load spring setting scale tooled into the outside surface of the first housing assembly and optionally, an application torque setting scale tooled into the outside surface of the magnetic clutch assembly, near the bottom edge thereof. It is contemplated within the scope of this invention to have a device that contains both a top load spring setting scale tooled into the outside surface of the first housing assembly and an application torque setting scale tooled into the outside surface of the magnetic clutch assembly.

DETAILED DESCRIPTION OF THE INVENTION

Figure 1:
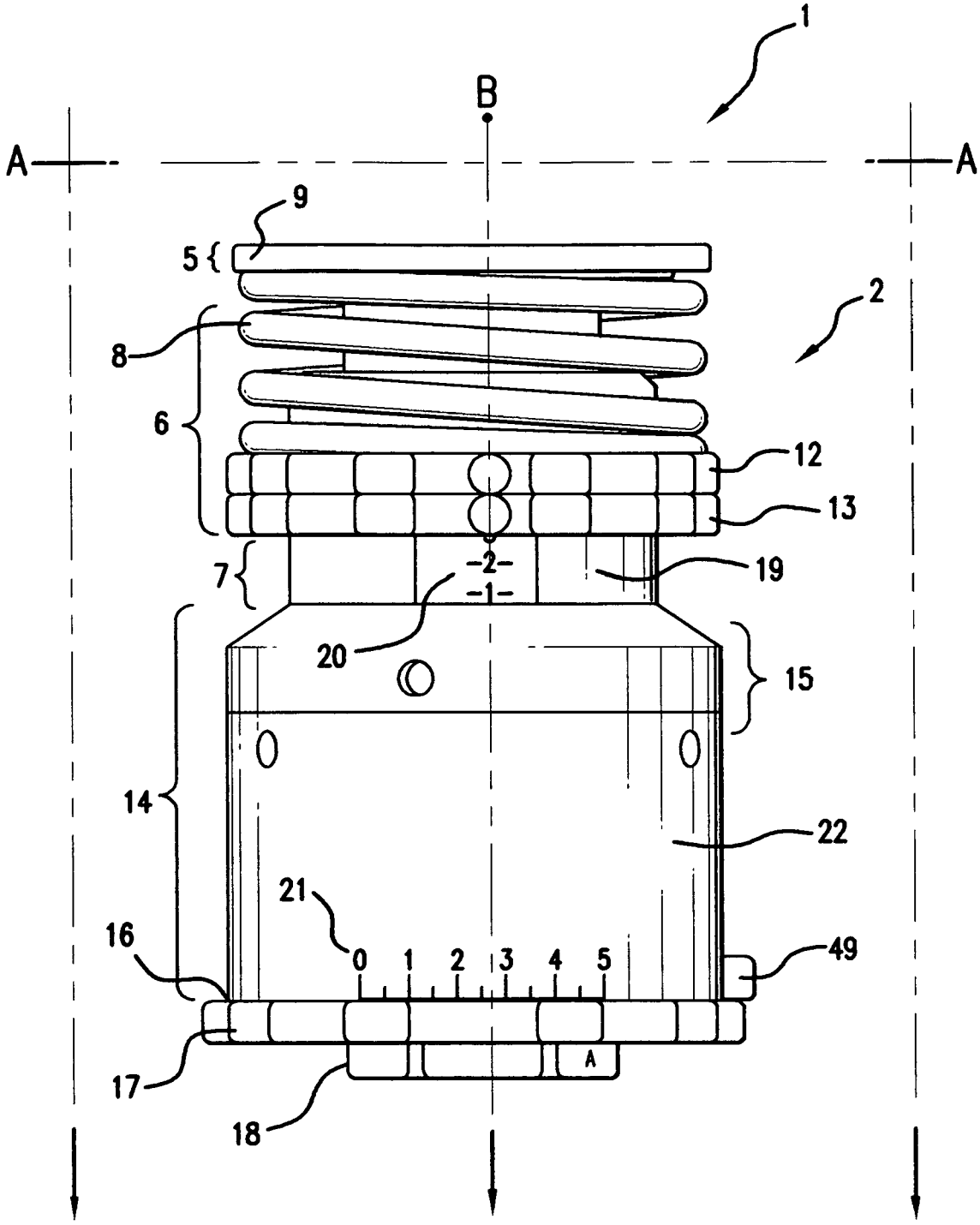
FIG. 1 is a full side view of a device of this invention.

Thus, the invention disclosed and claimed herein deals with a capping head assembly for capping containers. Turning now to FIG. 1, there is shown a full side view of a device 1 of this invention. There is shown a first housing assembly 2 that is securable to a drive spindle, not shown. The first housing assembly 2 has a top portion 5, a middle portion 6, and a lower portion 7, and the first housing assembly 2 has a compression spring 8 surrounding it.

Figure 2:
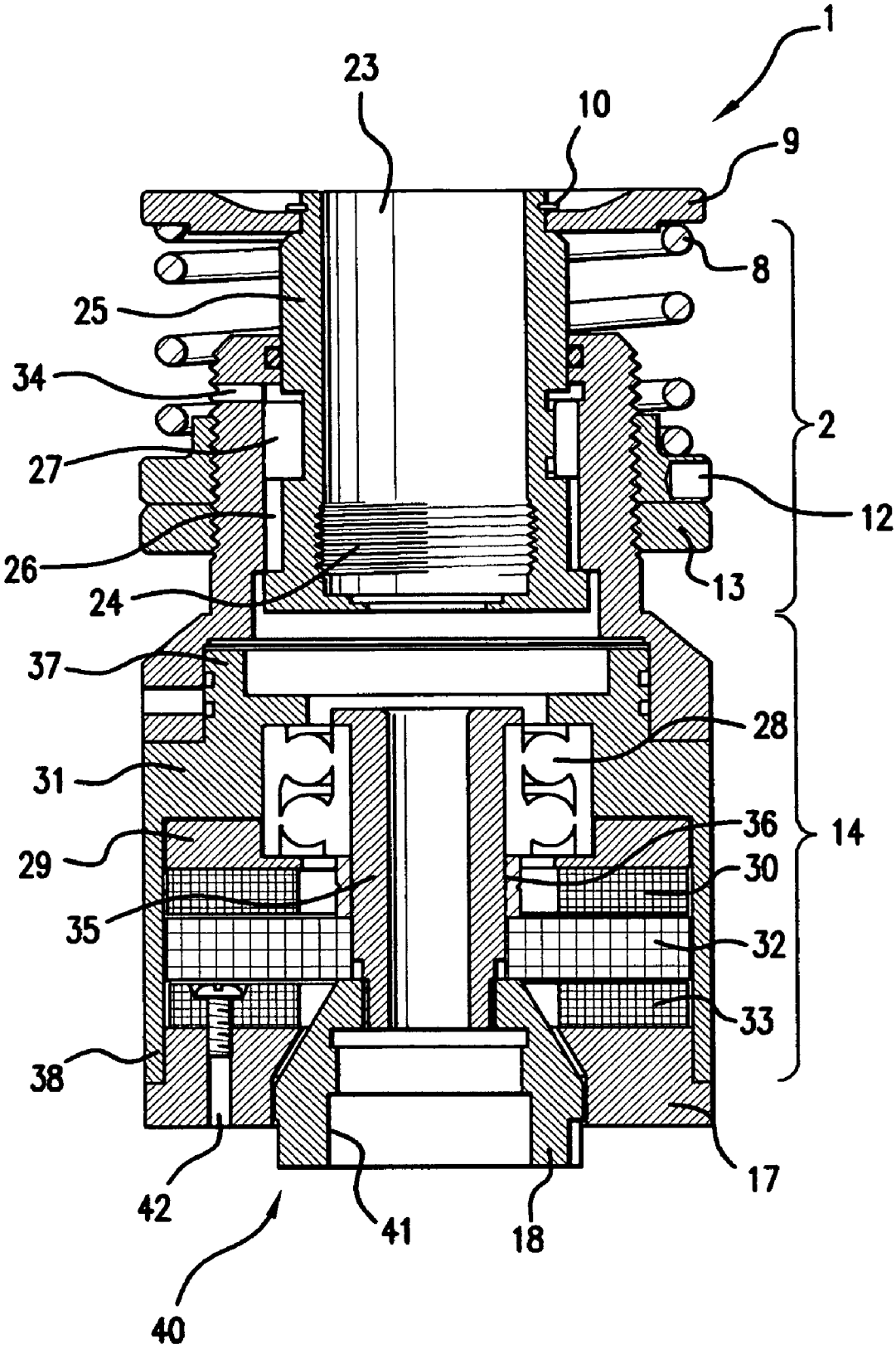
FIG. 2 is a full cross sectional side view of a device of this invention through the line A—A of FIG. 1.

The compression spring 8 is mounted beneath a spring retention plate 9 and held in place around the first housing assembly 2 by the spring retention plate 9 and the spring retention plate 9 is held in place by a retainer ring 10 (shown in FIG. 2). The compression spring 8 slidably rests on a moveable spring pre-load adjustment ring 12 that is threadedly mounted around the middle portion of the first housing assembly 2 and said moveable spring pre-load adjustment ring 12 works in conjunction with a jam nut 13 to provide an adjustment for the compression spring 8 in a vertical movement, and the jam nut 13 prevents the adjustment ring 12 from moving in either direction. This assembly allows one to control the amount of compression that is used in the assembly.

Threaded onto the bottom of the first housing assembly 2 is a magnetic clutch assembly 14, said magnetic clutch assembly 14 has an upper portion 15 and a bottom edge 16. Shown at the bottom edge 16 is a torque adjustment rotating end cap 17 which is used to adjust the internal magnets, discussed infra, and, a magnetic assembly clamping nut 18.

Shown on the outside surface 19 of the first housing assembly 2 is a spring pre-load setting index 20 that is tooled into the outside surface 19. Also shown is a torque setting index 21, that is located near the bottom edge 16 of the magnetic clutch assembly 14 and this index 21 is also tooled into the outside surface 22 of the magnetic clutch assembly 14, just above the lateral slot 51 and above the torque adjustment rotating end cap 17.

Turning now to FIG. 2, there is shown a full cross sectional side view of the device 1 of this invention, taken through line A—A of FIG. 1.

With regard to FIG. 2, there is shown a mounting shaft opening 23, that has internal threads 24. Also shown is the spring retention plate 9, the retainer ring 10, compression spring 8, moveable spring pre-load adjustment ring 12 and jam nut 13. In addition, there is shown the magnetic assembly clamping nut 18 and the torque adjustment rotating end cap 17.

The wall 25 of the first housing assembly 2 has semi-cylindrical indentions 26 located therein, typically about four such indentions. The indentions 26 are circumferentially located about the first housing assembly 2 and each holds a metal pin 27, which acts as a device to transmit torque from the drive spindle, thru wall 25 to the bottom portion 7 of the first housing assembly 2. Typically there are four such metal pins 27 in each first housing assembly 2 and it is preferred that these pins are manufactured out of stainless steel to prolong the life of such pins. The torque from the drive shaft is transmitted to the first housing assembly 2 through the metal pins 27. This permits the upper portion of the first housing assembly 5 to move relative to the entire first housing assembly 2 against the action of the compression spring 8 during which action the metal pins 27 will move in the semi-cylindrical indentions 26. The metal pins 27 provide a positive connection between the first housing assembly 2 and the lower portion 7 of the first housing assembly 2. Shown at 34 are lubricating ports for the metal pins 27. The lower portion 7 of the first housing assembly 2 has a threaded connection 37 between the first housing assembly 2 and the upper portion of 31 of lower assembly 14.

In the magnetic clutch assembly 14 there is an upper portion 15 and a bottom edge 16. The magnetic clutch assembly 14 comprises a first annular drive magnet 30 in a torque ring that is not movable relative to the magnetic clutch assembly 14. The first annular drive magnet 30 has a multiple pole configuration. There is a second annular drive magnet 33 in the magnetic clutch assembly 14 and this magnet has a multiple pole configuration. There is a means for adjusting the position of the torque ring 33 relative to said magnetic clutch assembly 14 and this means comprises a torque adjustment rotating end cap 17 that changes the polarity of the second annular magnet 33 in the magnetic clutch assembly 14 relative to the first annular drive magnet 30 in a predetermined position whereby the flux of the magnets can be changed to vary the torque limit of the magnetic clutch assembly 14. The torque adjustment rotating end cap 17 is rotatably mounted in the bottom end 16 of the magnetic clutch assembly 14.

Located within the upper double row angular contact thrust bearing magnetic clutch housing 31 is a annular double row angular contact bearing 28, which bearing has not been used in this type of assembly to the patentee's knowledge. The contact bearing 28 surrounds the lower shaft 35 and rests on a magnet mounting plate 29, and just beneath the magnet mounting plate 29 is a non-moveable annular first drive magnet 30. Directly seated beneath the non-moveable annular first drive magnet 30 is a annular hysteresis magnet 32, and just directly beneath the hysteresis magnet 32 is a moveable annular second drive magnet 33. The moveable annular second drive magnet 33 is held in place and attached to the torque adjustment rotating end cap 17 by screw or bolt 42 (FIG. 2).

It should be noted that the combination of the lower shaft 35, a spacer 36, the contact bearing 28 and the hysteresis magnet 32 are all held in place by the shaft nut 18. The moveable annular second drive magnet 33 is attached to the torque adjustment rotating end cap 17. By turning the torque adjustment rotating end cap 17, the moveable annular second drive magnet 33 can be moved in a circular motion.

Both of the annular drive magnets 30 and 33, are magnetized in a multiple pole configuration. If one envisions a pie that has been sliced into multiple pieces, each individual piece would represent a different pole. The hysteresis magnet 32 is located between the drive magnets 30 and 33. When the drive magnets 30 and 33 have poles of North and South that are directly lined up opposite each other, the magnetic flux goes straight through the center of the hysteresis magnet 32. This is the minimum torque position of this apparatus. When the poles of the drive magnets 30 and 33 line up North and North directly opposite each other, the flux goes into the center hysteresis magnet 32, travels circumferentially around the magnet, and then exits to a South pole. Because the flux travels so far within the hysteresis magnet 32, this is the maximum torque position of the magnets. Thus, in this invention, the torque is adjusted by changing the relative angular positions of the magnetic poles of the drive magnets 30 and 33 to each other, and the torque is not adjusted or influenced by the air gaps between the magnets as in the prior art devices.

In FIG. 1, it should be noted that there is a torque adjustment set screw 49 that is inserted through the wall 38 of the magnetic clutch housing 31 to impede the movement of the torque adjustment rotating end cap 17. When it is desired to adjust the torque, the screw 49 is loosened and the adjustment is made, then the screw 49 is tightened to hold the torque adjustment rotating end cap 17.

Figure 3:
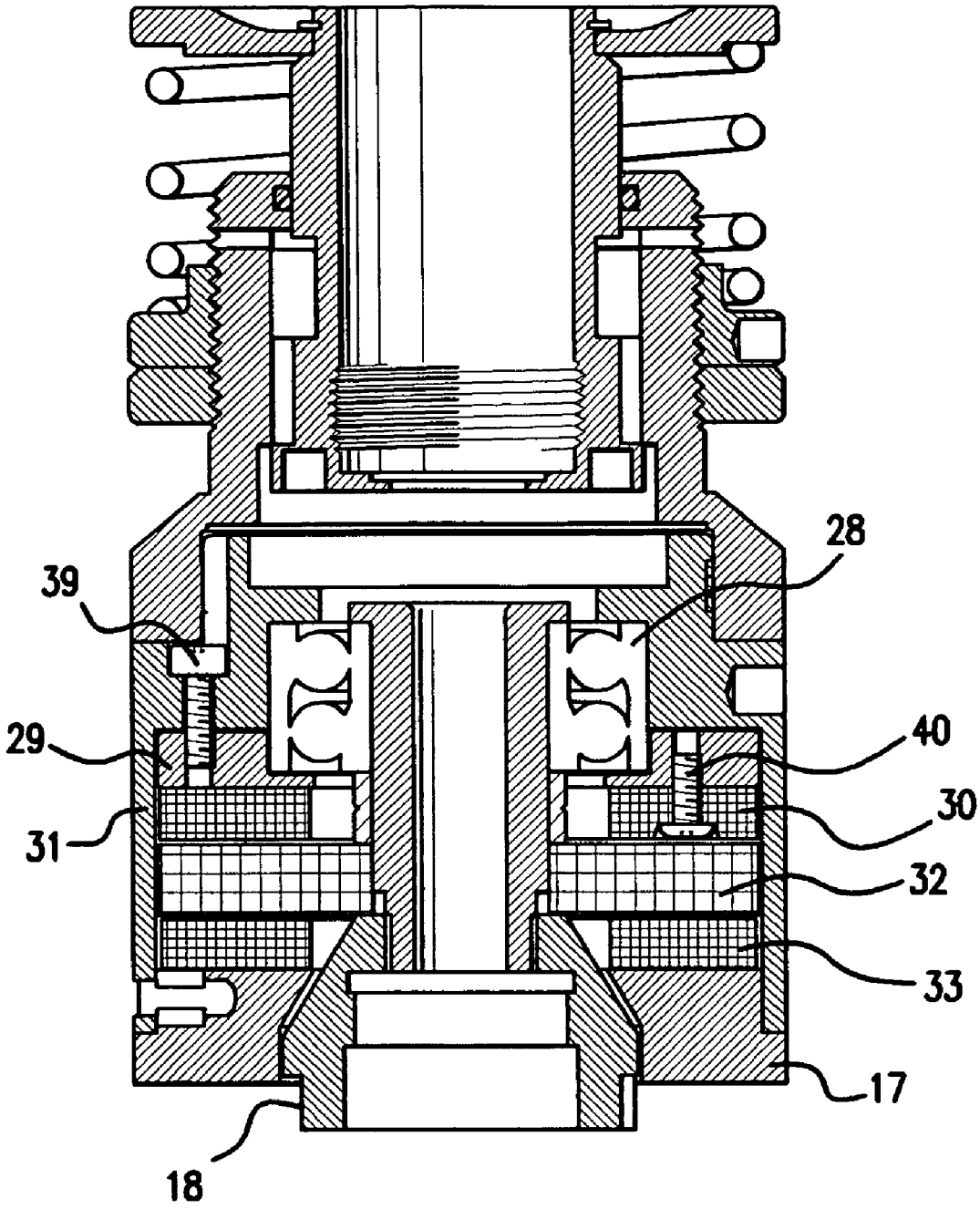
FIG. 3 is a cross sectional side view of a device of this invention taken through line B—B of FIG. 1, that is, the view of FIG. 2 at ¼ turn of the view of FIG. 1.

Turning now to FIG. 3, which is a full cross sectional side view of the device 1 of FIG. 1, through lines B—B of FIG. 1, there is shown a bolt 39 that holds the magnet mounting plate 29 to the magnetic clutch housing 31 and also there is shown a screw 40 that holds the first, non-moveable drive magnet 30 to the magnet plate 29, so that it cannot move out of position.

Figure 4:
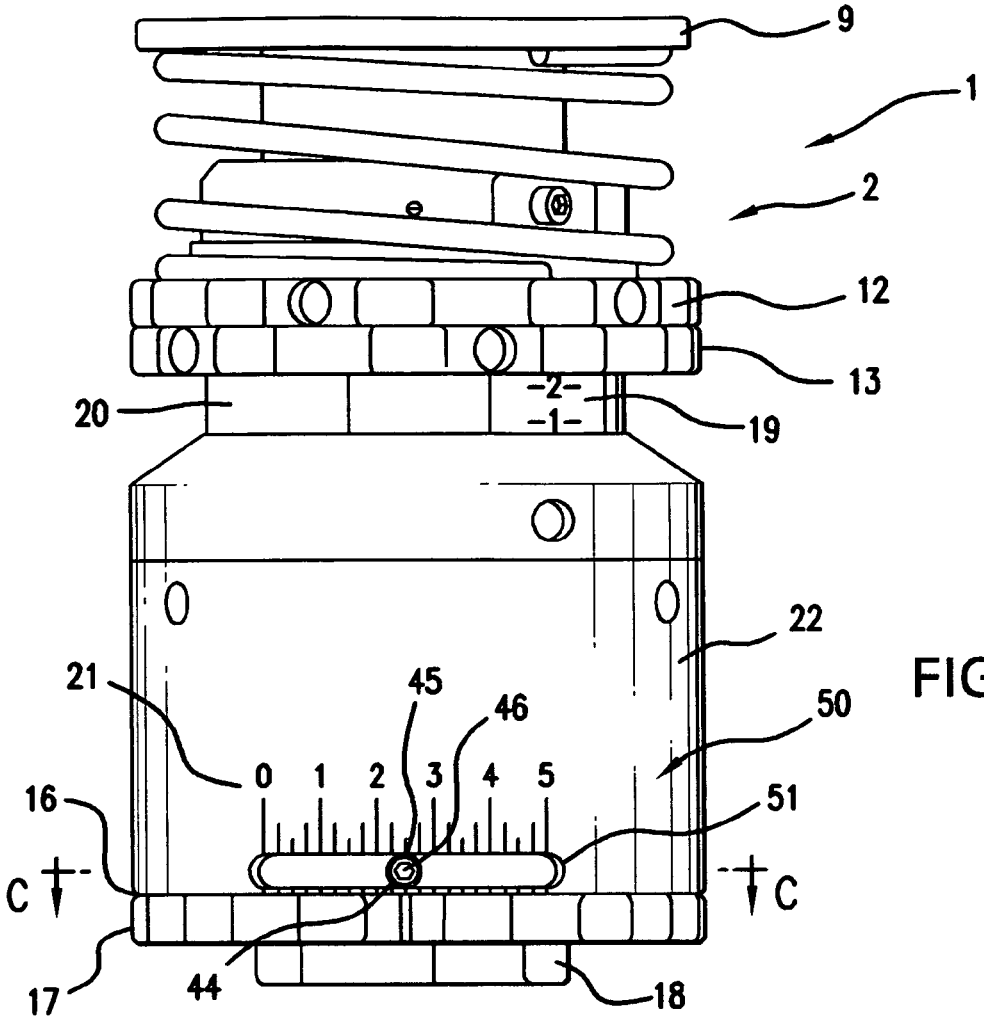
FIG. 4 is a full side view of another embodiment of this invention.
Figure 5:
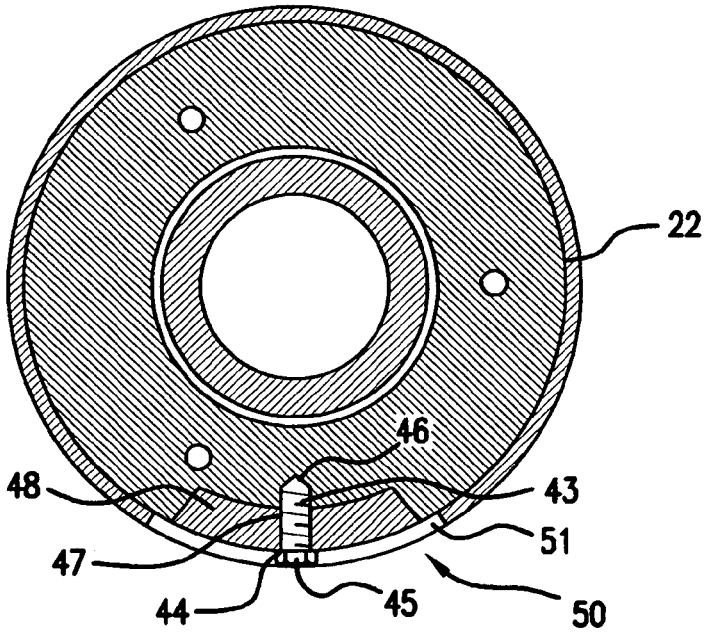
FIG. 5 is a full cross sectional top view taken through line C—C of FIG. 4.

Turning now to another embodiment of this invention, and with reference to FIGS. 4 and 5, there is shown a device 1 (FIG. 4) in full side view. FIG. 5 is a full cross sectional top view of the device of FIG. 4 through line C—C. This embodiment deals with another configuration for adjustment of torque of the device.

The torque adjustment device 50 of this invention as shown in FIGS. 4 and 5 is constructed of a hollow shaft 43, into which is inserted a threaded screw 44, the front end of which is shown at 45. The back end 46 of the hollow shaft 43 is constructed such that there is an indention 47 that fits up against the brake shoes 48. When the screw is loosened, the hollow shaft 43, with the screw 44 intact, and the brake shoes 48, can all be moved along a lateral line of movement to increase or decrease the torque. A horizontal slot 51 machined through the housing 22 provides the capability for a lateral line of movement. When the desired torque is achieved, the screw 43 is tightened whereupon the indention 47 of the hollow shaft 43 presses against the brake shoes 48 and locks the adjustment in place.

The terminal end 41 of the magnetic clutch assembly contains a chuck, not shown, that is used to grip the caps that are used for capping containers.

What is claimed is:

1. A capping head assembly comprising:

(I) a first housing assembly securable to a drive spindle, said first housing assembly having an outside surface and said first housing assembly having a top portion, a middle portion, and a lower portion;

(II) a spring retention plate surmounting the first housing assembly;

(III) a compression spring mounted beneath the spring retention plate and surrounding the first housing assembly, said spring slidably resting on a movable adjustment ring that is threadedly mounted around the middle portion of the first housing assembly;

(IV) a magnetic clutch assembly having an upper portion and a bottom edge and comprising:

(i) a first annular drive magnet in a torque ring that is not movable relative to the magnetic clutch assembly having a multiple pole configuration;

(ii) a second annular drive magnet in the magnetic clutch assembly having a multiple pole configuration;

(iii) a moveable hysteresis annular magnet interposed between (i) and (ii), said magnets being axially spaced from each other;

(V) a means for adjusting the position of the second annular drive magnet relative to said magnetic clutch assembly, said means comprising a torque adjustment rotating end cap, that changes the polarity of the second annular magnet in the magnetic clutch assembly relative to the first annular drive magnet in a predetermined position whereby the flux of the magnets can be changed to vary the torque limit of said magnetic clutch assembly, said torque adjustment rotating end cap being rotatably mounted in the bottom end of magnetic clutch assembly;

(VI) a means for securing the second annular drive magnet relative to said magnetic clutch assembly to retain said second annular drive magnet in a fixed position;

(VII) a double row angular contact thrust bearing located in the upper portion of the magnetic clutch assembly and encircling the rotatable drive member, said double row angular contact thrust bearing surmounting the annular series of magnets.

2. The capping head assembly as claimed in claim 1 wherein, in addition, there is a top load spring setting scale tooled into the outside surface of the first housing assembly.

3. The capping head assembly as claimed in claim 1 wherein, in addition, there is an application torque setting scale tooled into the outside surface of the magnetic clutch assembly, near the bottom edge thereof.

4. The capping head assembly as claimed in claim 1 wherein, in addition, there is a top load spring setting scale tooled into the outside surface of the first housing assembly and an application torque setting scale tooled into the outside surface of the magnetic clutch assembly, near the bottom edge thereof.

5. The capping head assembly as claimed in claim 1 wherein there is a solid lubricant packed into the double row angular contact thrust bearing.

6. The capping head assembly as claimed in claim 1 wherein the means for securing the second annular drive magnet relative to said magnetic clutch assembly to retain said second annular drive magnet in a fixed position is a set screw positioned through the housing of the magnetic clutch assembly near the bottom edge.

7. The capping head assembly as claimed in claim 1 wherein the means for securing the second annular drive magnet relative to said magnetic clutch assembly to retain said second annular drive magnet in a fixed position is a combination of a lateral slot through a wall of the magnetic clutch assembly, said wall having an interior surface, wherein there is a hollow shaft inserted through the lateral slot, said hollow shaft containing therein a threaded screw having a back end and wherein the threaded screw has an indention in the back end, which indention faces a set of brake shoes that interface with the interior surface of the magnetic clutch assembly wall.

* * * * *